US008117696B2

(12) United States Patent
Wernqvist et al.

(10) Patent No.: US 8,117,696 B2
(45) Date of Patent: Feb. 21, 2012

(54) ARTICULATED BED

(75) Inventors: Björn Wernqvist, Hägersten (SE); Göran Wernqvist, Nacka Strand (SE); Peter Svensson, Tyresö (SE); Susanne Wedbjer, Solna (SE)

(73) Assignee: SHL Group AB, Nacka Strand (SE)

( * ) Notice: Subject to any disclaimer, the term of this patent is extended or adjusted under 35 U.S.C. 154(b) by 810 days.

(21) Appl. No.: 12/093,803

(22) PCT Filed: Nov. 11, 2006

(86) PCT No.: PCT/SE2006/001275

§ 371 (c)(1),
(2), (4) Date: Sep. 3, 2008

(87) PCT Pub. No.: WO2007/058578

PCT Pub. Date: May 24, 2007

(65) Prior Publication Data

US 2011/0138536 A1 Jun. 16, 2011

Related U.S. Application Data

(60) Provisional application No. 60/737,396, filed on Nov. 17, 2005.

(30) Foreign Application Priority Data

Nov. 17, 2005 (SE) ..... 0502525

(51) Int. Cl.
*A61G 7/015* (2006.01)
*A61G 7/005* (2006.01)
*A61G 7/012* (2006.01)

(52) U.S. Cl. ..... 5/618; 5/610; 5/611

(58) Field of Classification Search ..... 5/618, 610, 5/611, 613, 616, 617, 662
See application file for complete search history.

(56) References Cited

U.S. PATENT DOCUMENTS 3,281,141 A * 10/1966 Smiley et al. ..... 5/614
(Continued)

FOREIGN PATENT DOCUMENTS

WO 02074221 A1 10/1995

OTHER PUBLICATIONS

PCT International Search Report, mailed Feb. 15, 2007, in connection with International Application No. PCT/SE20061001275.

*Primary Examiner* — Robert G Santos
(74) *Attorney, Agent, or Firm* — Potomac Patent Group PLLC

(57) ABSTRACT

The present invention refers to an articulated bed arrangement having a patient support platform 2 comprising at least a head section 4, a seat section 6 and a foot section 8 connected to each other in an articulated manner so that the bed arrangement is convertible at least from a bed configuration to a chair configuration. The platform has a length and a width whereupon the platform is projecting an area onto the floor when said sections are horizontally arranged. The bed arrangement is further provided with a leg arrangement comprising four legs 20*a*, 20*b*, 20*c*, 20*d* that are pivotable in the vertical direction in relation to the longitudinal direction of the platform about their articulated connection points 22*a*, 22*b*, 22*c*, 22*d* to the platform in order to change the height from the floor to the surface of the platform. Each leg is provided so that said leg is positioned outside said projected area.

11 Claims, 9 Drawing Sheets

U.S. PATENT DOCUMENTS 3,284,126 A * 11/1966 Piazza ..... 296/20
4,398,313 A * 8/1983 Mitchell ..... 5/616
4,858,260 A * 8/1989 Failor et al. ..... 5/618
5,337,430 A * 8/1994 Schlein ..... 5/662
5,398,357 A * 3/1995 Foster ..... 5/619
5,454,126 A 10/1995 Foster et al.
5,682,631 A * 11/1997 Weismiller et al. ..... 5/618
6,230,344 B1 * 5/2001 Thompson et al. ..... 5/611
6,336,235 B1 1/2002 Ruehl
2005/0120485 A1 * 6/2005 Sebastien ..... 5/662
2011/0138536 A1 * 6/2011 Wernqvist et al. ..... 5/618

* cited by examiner

ARTICULATED BED

TECHNICAL FIELD

The present invention refers to an articulated bed arrangement that is convertible at least from a bed configuration to a chair configuration. The height from the floor to the surface of the bed is adjustable by means of a novel movable leg arrangement. Different movements of the articulated sections of the bed in cooperation with different movements of the leg arrangement will result in different novel articulated bed configurations.

PRIOR ART

Due to our high standards of living, the population within the developed countries tend to get older and older. As of today, approximately 17% of the European population is above 65 years of age but calculations have predicted that in about twenty years this number will raise to approximately 25%. Approximately 6-7% will at that time belong to the older elderly, i.e. the part of the population being above 80 years of age.

At the present, approximately 3% of the population in for instance Sweden is comprehended in the elderly care. About half is taken care of within "Special living arrangements" and half in their ordinary homes, with the care in special living being twice as costly as home care. It is not hard to predict that the costs for the elderly care within the near future will raise due to the increasing number of elderly people. This is most probably true for most of the developed countries in the world. Therefore, it would be very profitable for the society if the elderly people could be taken care of in their home environment as long as possible with the care being performed by relatives in the homes, such as a husband or a wife. This would also very much likely be appreciated by the family concerned.

There are however a number of presumptions for the elderly person to remain at home. For instance, the environment must be safe and secure, comfortable and functionally adapted. For a person with reduced capability and disability a big concern is the concept of getting into and out of the bed and there are a lot of safety aspects to attend to in order to reduce the risk of accidents to occur.

For instance, for a person with reduced capability, it is easier to get out of the bed from the foot end there of, instead of having to roll over to his or hers side and then get out of the bed from the side thereof. Therefore, beds are known that are convertible to a chair in order to facilitate for the person to get out of the bed from the foot end thereof, i.e. to simply stand up from the chair. Such beds are for instance known as articulated beds or chair beds.

U.S. Pat. No. 5,454,126 (Foster et al.) describes an articulated hospital bed that is convertible to a chair for patient egress from the foot end of the bed. The bed described by Foster et al., comprises a wheel provided base 12 with a frame 14 carrying a patient support platform 18 consisting of a head-, seat-, thigh- and a foot panel, i.e. 28, 30, 32 and 34, respectively. In FIGS. 10A-10D is shown how the bed in subsequent steps are turned into a chair by moving the different panels relative to the frame. When the bed is converted to the chair configuration, the bed is described to vacate an area at the foot end of the bed to provide a space for docketing a wheel chair or other ambulatory assisting device.

It is true that the bed described by Foster et al., will vacate more space at the foot end thereof when in the chair configuration as compared to when in the bed configuration. However, the bed and/or the chair will at all times occupy at least as much space as the base and the frame require. Moreover, having the different panels moving relative to a frame as shown in U.S. Pat. No. 5,454,126, will also result in that there is a substantial risk for the patient, or the care giver, to for instance getting a hand or a finger caught in between a moving panel and the frame, which would be highly undesirable. The rather space requiring bed shown by Foster et al., is thus not very likely to be placed in the ordinary home of a person with reduced capability requiring extra care by a relative or the like.

Another safety aspect to attend to when designing a bed for a disabled person, is the risk for the patient to fall out of the bed. If one wants to avoid the use of bars or gates or the like provided at the side of the bed preventing that the patient falls out, one could instead design the bed so that its height from the floor is adjustable. The height from the floor to the sleep surface of the bed can thus be as low as possible when the bed is used for sleeping in order to avoid the injuries of the person if he should fall out of the bed.

WO 02/074221 (XDIN AB) describes an adjustable articulated bed comprising three sections, a middle 12*a*, a head-end 12*b* and a foot 12*c* section, supported by a central casing 10 placed substantially centrally under the bed in the longitudinal as well as the transverse direction thereof. The head-end section and the foot section are connected to the middle section in an articulated manner such that head-end and foot sections can be pivoted upwards and downwards, respectively. A telescopic leg arrangement 11 is connected to each end of the central casing. Each telescopic leg arrangement has an upper leg 22 connected in an articulated manner to the central casing at a hinge, such that the upper leg can move upwards and downwards in the vertical direction. A wheel provided two-leg stand 24 is then arranged in a telescopically displaceable manner in each upper leg. With means of the telescopic leg arrangement, the central casing and thus the mattress base can be lowered and raised with out any great change in the distance between the wheels of the stands, respectively, see FIGS. 8-10 of WO 02/074221. The minor change in distance between the wheels is described to subject the floor to minimal wear.

Even though the adjustable bed described in WO'221 derives several advantages from its telescopic leg arrangement and its centrally placed central casing, one drawback with the arrangement described, is that the vertically downward directed force exerted by the mattress base, is only divided into to two force components, each carried by one leg stand only. Thus, the hinges for instance, that connect each upper leg to the central casing, are subject to relatively high forces.

Also, even though the height from the mattress base to the floor is easily adjusted, the two-leg stands occupy unneedful space under the bed. The actual height of the bed arrangement from the floor is never higher than the height from the floor to the connection point between the two "legs" of a two-leg stand. When the bed is in a nursing position, i.e. when the sections are all horizontally arranged and the height of the mattress base from the floor is relatively high (see FIG. 8), it is for instance not possible to slide in objects, like needful nursing arrangements or the like, from the foot or head end of the bed if such an object can not fit in under the two-leg stand.

Moreover, for a disabled person, it is hard to get out from the foot end of the bed described in WO'221, since the foot section of the bed not can be pivoted downwards in the vertical direction such that said foot section is vertically arranged. Said bed is simply not construed as to facilitate patient egress from the foot end thereof. In fact WO'221 does not mention or discuss the problem with the concept of getting out of bed at all. The bed is construed as to solve other problems.

Thus there is a need for an adjustable bed arrangement that is adapted to be used in the home environment of a person with reduced capability in a safe and secure way. Such a bed arrangement should thus be adapted to:

- be convertible at least from a bed configuration to a chair configuration
- facilitate egress from the foot end of the bed,
- occupy as little space as possible,
- have an easily adjustable height from the floor to the surface of the bed, such that the height can readily be changed from being low when the bed is in a sleep configuration to being relatively high when the bed is in a nursing configuration.

DISCLOSURE OF THE INVENTION

The object of the present invention is thus to provide an articulated bed arrangement that satisfies the above described need. This is accomplished by means of an articulated bed arrangement according to the preamble of the independent claim and provided with the features according to the characterizing portion of the independent claim.

Preferred embodiments are set forth in the dependent claims.

The articulated bed arrangement is further adapted to adopt a number of novel configurations by means of the articulated sections and legs of the inventive arrangement.

Said arrangement also minimizes the forces acting on the articulated legs of the articulated bed in comparison with prior art articulated beds provided articulated legs.

The articulated bed of the present invention is also adapted to provide assisting means that is adapted to assist a person who for instance is getting out of or into the bed.

DETAILED DESCRIPTION OF THE INVENTION

Figure 1A:
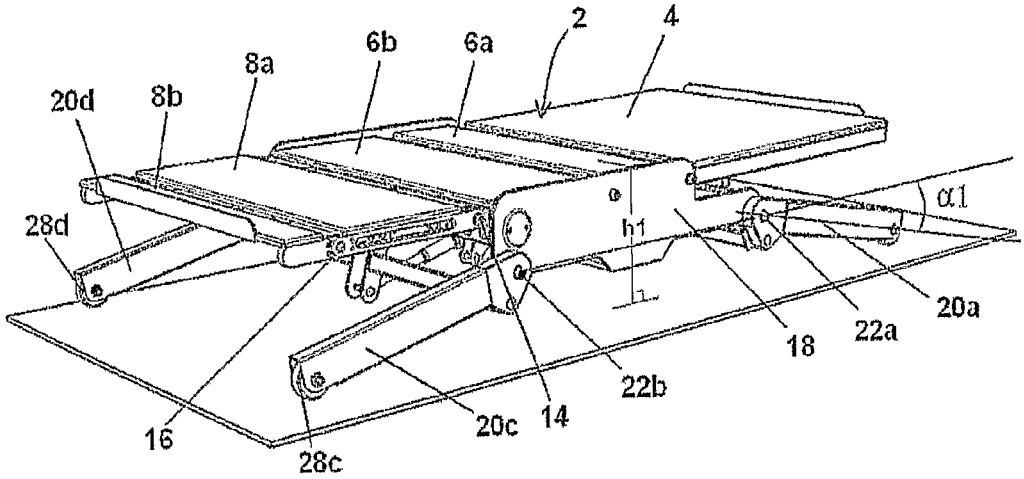
FIG. 1*a* illustrates the inventive arrangement as seen in an elevated view when in a sleep configuration.

The articulated bed arrangement of the present invention has a patient support platform 2 having a length and a width, that comprises at least three sections; a head section 4, a seat section 6 and a foot section 8. In a preferred embodiment, the seat section 6 is further divided into a first and a second seat section, 6*a* and 6*b*, respectively, which is also the case for the foot section 8, which preferably is further divided into a first and a second foot section, 8*a* and 8*b*, respectively. As seen in for instance FIG. 1*a*, the head end section 4 is the longest section, and the seat section 6 is slightly longer than the foot section 8. When in the preferred embodiment, the first seat section 6*a* is adapted to be slightly shorter than second seat section 6*b*, and the first foot section 8*a* is adapted to be longer than the second foot section 8*b*. The widths of said sections are essentially the same. However, the actual lengths and widths of the sections of the bed are not critical to the function of the bed and the skilled person is well capable of choosing suitable dimensions of the sections, respectively, such that they are well suited for their special purpose, see further description below. The total length and width of the platform 2, i.e. the sum of all lengths of the sections and the width of the sections, preferably correspond to that of an ordinary bed.

The sections of the platform of the bed are connected to each other in articulated manners. In the preferred embodiment, the head end section 4 and the first seat section 6*a* are connected to each other in an articulated manner about a hinge 10 such that the head end section can be pivoted upwards in the vertical direction about hinge 10. The first seat section 6*a* and the second seat section 6*b* are connected to each other in an articulated manner about a hinge 12, such that the second seat section 6*b* can be pivoted upwards in the vertical direction about hinge 12. Second seat section 6*b* is then in an articulated manner connected to first foot section 8*a* about a hinge 14, such that first foot section can be pivoted downwards in the vertical direction about hinge 14. A hinge 16 connect the second foot section 8*b* to the first foot section 8*a* in an articulated manner, such that the second foot section 8*b* can be pivoted upwards in the vertical direction about hinge 16.

At each outer long side of the patient support platform 2, centrally in the longitudinal direction thereof, is a longitudinal leg base member 18 provided, constituting a member for connecting the legs in a pivotable manner to the platform 2. The leg base member preferably extends in the longitudinal direction of the bed such that the length of the leg base member 18 approximately corresponds to the length of the seat section 6, or the combined length of the seat sections 6*a* and 6*b*. At each longitudinal end of the leg base members 18 is a leg 20 provided in an articulated manner, i.e. the bed is provided with in total four legs, 20*a*-20*d*. Legs 20*a* and 20*b* are provided at opposite long sides of the bed, closer to, and at the same distance from, the head end of the bed. Accordingly, legs 20*c* and 20*d* are provided at opposite long sides of the bed, closer to, and at the same distance from, the foot end of the bed. Each leg 20 is provided at the leg base member about a hinge 22*a-d*, such that the legs 20 are adapted to be pivoted downwards in the vertical direction about their corresponding hinges.

In one embodiment, the legs 20*a* and 20*b*, and legs 20*c* and 20*d*, are adapted to be operate in terms of short side pairs. That is, when leg 20*a* is pivoted for instance downwards in the vertical direction about its hinge 22*a* with a certain angle, leg 20*b* is pivoted downwards with the same angle about its hinge 22*b*. The same applies for the short side leg pair 20*c* and 20*d*.

In another embodiment, the legs 20*a* and 20*c*, and legs 20*b* and 20*d*, are adapted to work together in terms of long side pairs. That is, when leg 20*a* is pivoted for instance downwards in the vertical direction about its hinge 22*a* with a certain angle, leg 20*c* is pivoted downwards with the same angle about its hinge 22*c*. The same applies for the long side leg pair 20*b* and 20*d*.

The means that make the sections of the platform and the legs pivot about their corresponding hinges will be described in further detail later on in the description text.

Each leg is provided with a wheel 28*a-d* at the distal end of the leg, which wheel is adapted to be in contact with the floor. The wheels are preferably of a size and a design and provided at the end of the legs in such a way that they may slide easily along the floor. They are further preferably provided with locking means (not shown) such that they may be locked in certain positions of choice.

According to the invention, the height of the bed from the floor is easily adjusted with suitable movements of the legs 20 about their corresponding hinges 22, as will be described below in connection with FIG. 1*a-h*. Furthermore, suitable movements of the legs in cooperation with suitable movements of the different sections of the platform will provide for an articulated bed arrangement that can adopt several different configurations as will be described below. One advantage with the bed leg arrangement of the present invention, as compared to the prior art bed leg arrangement shown in WO'221, is that the vertically downward directed force exerted by the patient support platform, is with the present invention divided into to four force components, each carried by one of the legs. Thus, the forces that act on the hinges 22 are reduced.

FIGS. 1*a*-1*h* illustrate schematically different configurations of the articulated bed arrangement, wherein the different sections of the bed have adopted different configurations in relation to each other in cooperation with different movements of the legs. It is to be understood that the configurations shown and explained below, do not constitute an exhaustive list but that further configurations are conceivable with the inventive articulated bed arrangement. Some of the configurations will be described in further detail later on in the description.

FIG. 1*a* shows a configuration of the bed, wherein all the sections of the bed are arranged horizontally. The legs 20 are pivoted about their corresponding hinges 22 a certain angle $\alpha 1$ in relation to the horizontal direction of the bed, such that the height h1 from the floor to the surface of the bed is as low as possible. This configuration is for instance well suited as a sleep configuration of the bed, wherein a suitable height h1 from the floor to the sleep surface of the bed is approximately 20 cm.

Figure 1B:
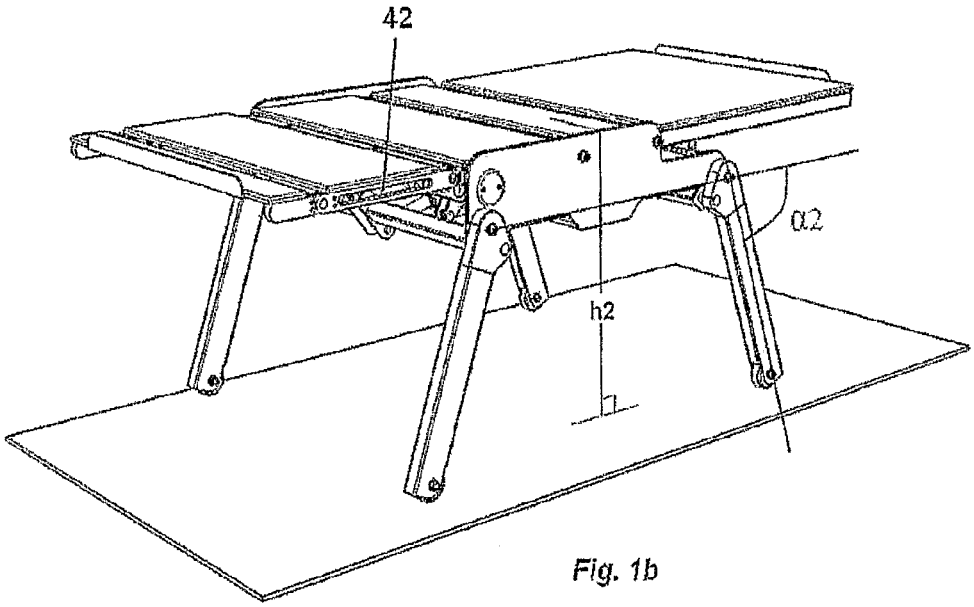
FIG. 1*b* illustrates the inventive arrangement as seen in an elevated view when in a nursing configuration.

FIG. 1*b* shows the configuration of FIG. 1*a*, but wherein the legs are pivoted about their corresponding hinges 22 a certain angle $\alpha 2$ in relation to the horizontal direction of the bed, wherein $\alpha 2 > \alpha 1$, such that the height h2 from the floor to the surface of the bed is considerably higher than when in the sleep configuration, i.e. h2>h1. This configuration is for instance well suited as a nursing configuration of the bed, wherein a suitable height h2 from the floor to the sleep surface of the bed is approximately 70 cm. This is a comfortable height when giving medical treatment, changing sheets etc. When the bed is in the nursing configuration it is also easy to clean the floor under the bed and due to the novel placement of the legs, the height from the floor to the lowest point under the bed is also relatively high. This makes it easy to slide in larger objects under the bed, also from the foot and head end thereof. The legs of the inventive articulated bed arrangement thus occupy as little space as possible under the bed, since they are positioned outside the area that the patient support platform projects onto the floor. There are in fact no legs at all present under the bed.

Figure 1C:
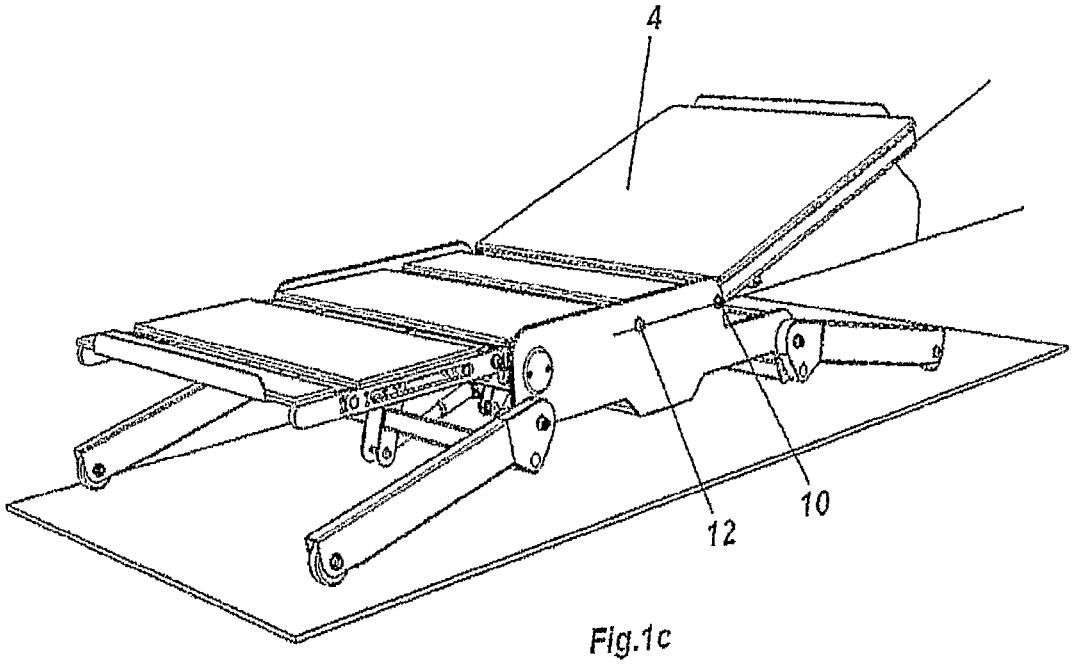
FIG. 1*c* illustrates the inventive arrangement as seen in an elevated view when in a sleeping configuration with raised head section.

FIG. 1*c* shows a configuration of the bed, wherein the head section 4 is pivoted slightly upwards about the hinge 10 and wherein all other sections of the platform are arranged horizontally. This configuration is for instance well suited as a sleep configuration of the bed, wherein the head of the person sleeping in the bed should be positioned slightly raised, for instance in order to facilitate breathing and prevent snoring. In this configuration, the legs preferably have the positions shown and described in connection with FIG. 1*a*. If the head section is pivoted even further upwards, and if the legs for instance are pivoted further downwards in the vertical direction, the configuration may also be comfortable for a person that wants to sit up in the bed. The legs can thus be pivoted in the vertical direction about their corresponding hinges with any desired angle, such that the height from the floor to the surface of the bed can be anywhere between the lowest or the highest possible.

Figure 1D:
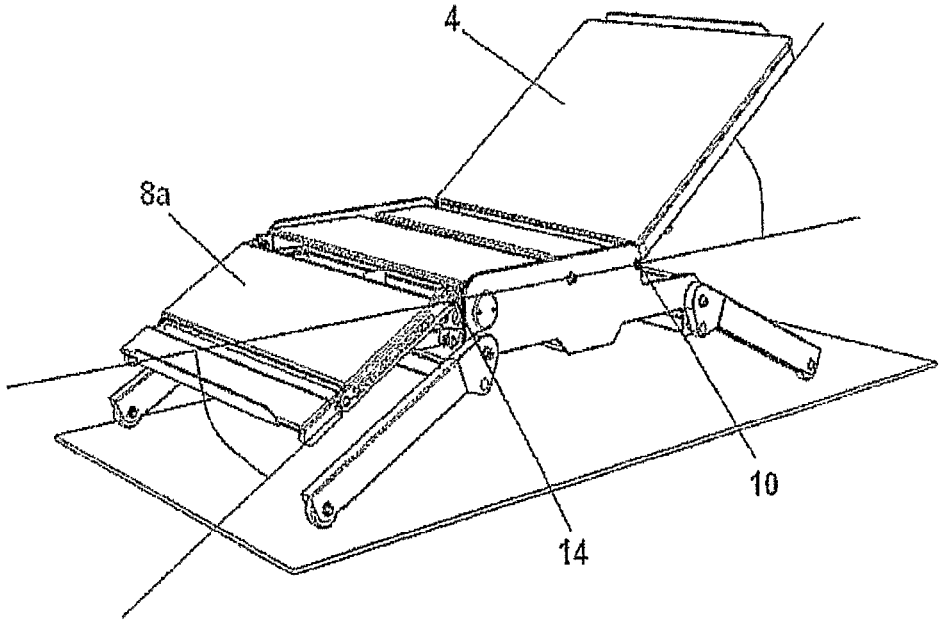
FIG. 1*d* illustrates the inventive arrangement as seen in an elevated view when in a resting configuration.

FIG. 1*d* shows a configuration of the bed with the head end section 4 pivoted upwards about hinge 10, and first foot section 8*a* pivoted downwards about hinge 14. This configuration is suitable when a person wants to assume a resting position in the bed. The short side leg pairs can in this configuration be pivoted about their corresponding hinges with any desired angle.

Figure 1E:
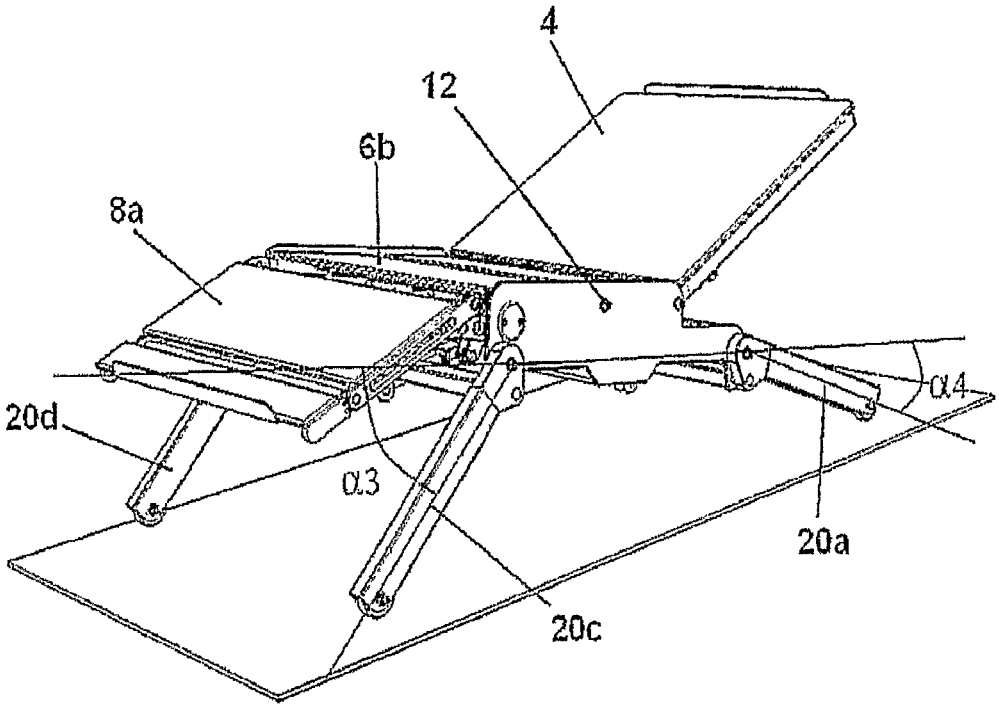
FIG. 1*e* illustrates the inventive arrangement as seen in an elevated view when in a sit up with bowed legs configuration.

FIG. 1*e* shows a configuration with the head end section 4 pivoted upwards about hinge 10, the second seat section 6*b* slightly pivoted upwards about hinge 12 and the first foot section 8*a* pivoted downwards about hinge 14. This configuration is well suited when a person wants to sit up in the bed with his legs bowed. In this configuration, the short side leg pair 20*c* and 20*d* are preferably pivoted downwards in the vertical direction about their corresponding hinges 22*c* and 22*d*, respectively, with an angle $\alpha 3$ that is larger than the angle $\alpha 4$ that the leg pair 20*a* and 20*b* is pivoted with about their corresponding hinges 22*a* and 22*b*, respectively. This will raise the foot end of the bed in relation to the head end and pivot the second seat section upwards in the vertical direction about hinge 12.

Figure 1F:
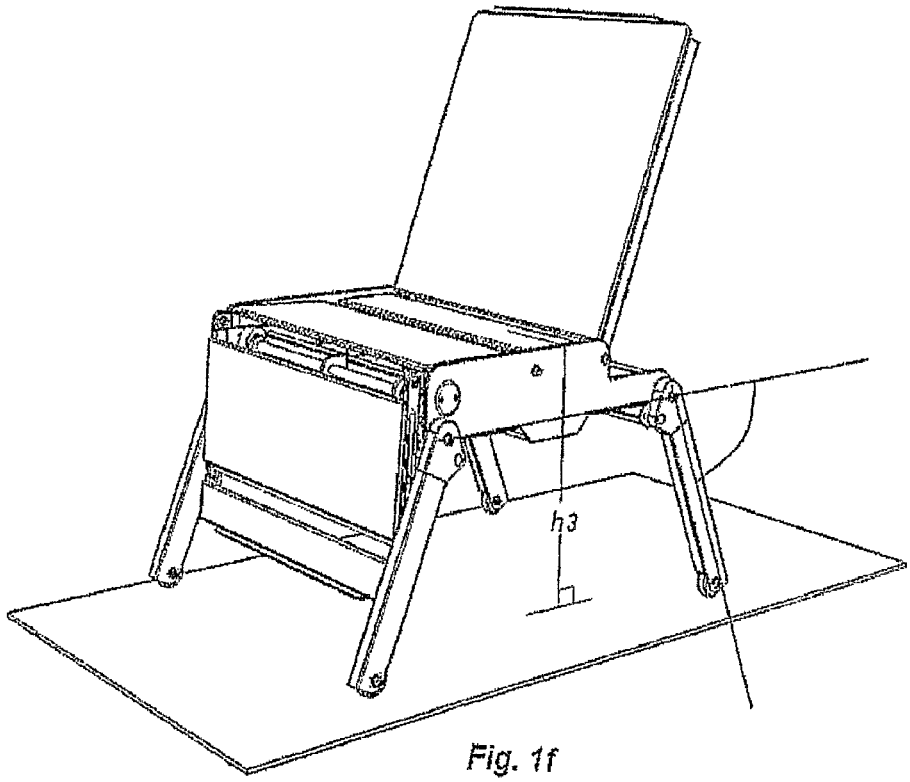
FIG. 1*f* illustrates the inventive arrangement as seen in an elevated view when in a sit right up configuration.

FIG. 1*f* shows a configuration with the head end section pivoted upwards about hinge 10 and the first foot section pivoted downwards about hinge 14. This configuration is for instance well suited when a person wants to sit upright in the bed. In this configuration, the legs are pivoted downwards in the vertical direction about their corresponding hinges preferably with an angle that corresponds to a comfortable seat height h3 from the floor, which is 45-50 cm. If the foot section is hitting the floor when the first foot section 8*a* is pivoted downwards, the second foot section will be pivoted upwards about hinge 16 by means of the forces acting on said section by the floor.

Figure 1G:
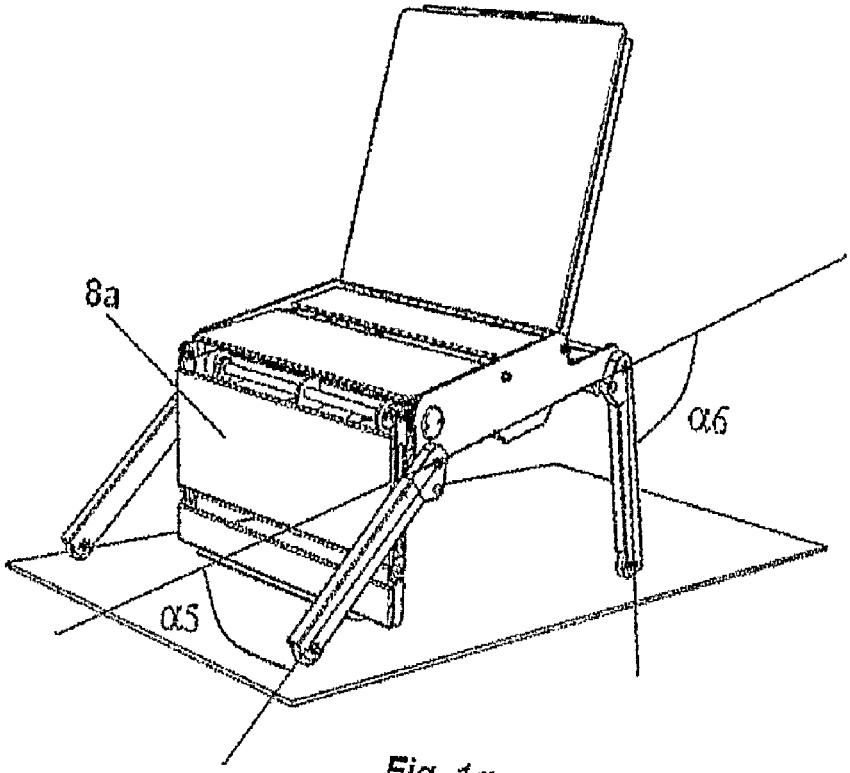
FIG. 1*g* illustrates the inventive arrangement as seen in an elevated view when in a raise from bed configuration.

FIG. 1*g* shows the configuration of FIG. 1*f*, but with the first foot section 8*a* pivoted even further downwards about hinge 14, such that the first foot section 8*a* is not perpendicularly arranged when the bed is seen from the side, but folded in under the bed with a certain angle (not indicated in FIG. 1*g*). The second foot section 8*b* can be pivoted upwards in the vertical direction about hinge 16 if the foot section hits the floor as described above. The short side leg pair 20*c* and 20*d* is pivoted downwards in the vertical direction with an angle α5 that is larger than the angle α6 that the short side leg pair 20*a* and 20*b* is pivoted downwards in the vertical direction with. This will lower the foot end of the bed in relation to the head end, i.e. the chair is tilting forward, facilitating patient egress from the foot end of the bed. The configuration of FIG. 1*g* is also well suited when there is a need for the creation of extra space at the foot end of the bed for other reasons, as for instance the docketing of a wheel chair at the foot end of the bed. Naturally, the first foot section 8*a* can be folded in under the bed without tilting the chair forward as shown in the figure, thus just creating extra space at the foot end.

Figure 1H:
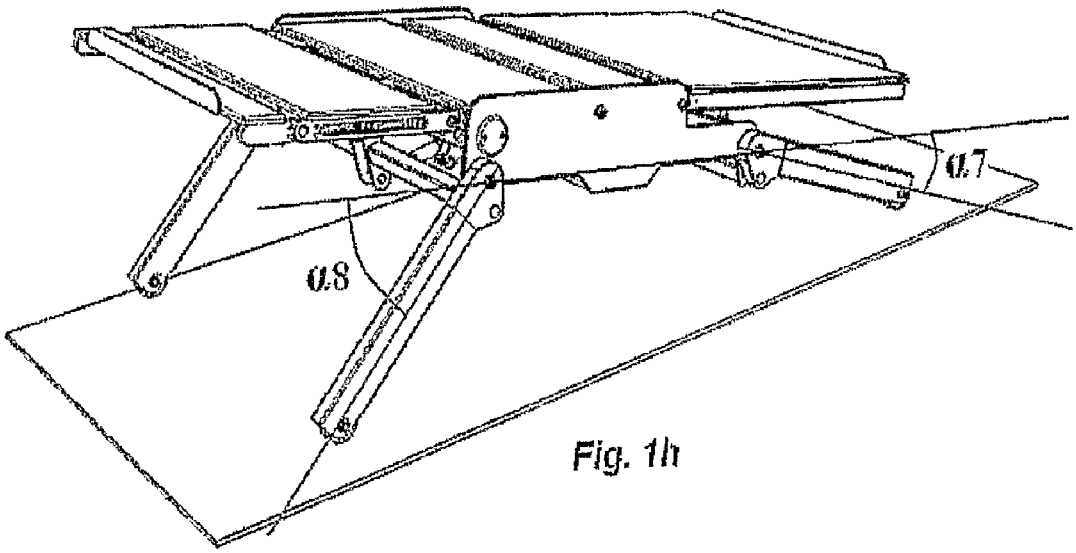
FIG. 1*h* illustrates the inventive arrangement as seen in an elevated view when in a tilted configuration.

FIG. 1*h* shows a configuration of the bed when all sections are horizontally arranged, wherein the short side leg pairs closer to the head end of the bed, i.e. legs 20*a* and 20*b*, has been pivoted downwards in the vertical direction about their corresponding hinges with an angle α7 that is smaller than the angle α8 that the other short side leg pair has been pivoted with. This results in that the head end of the bed is lowered in relation to the foot end. This configuration is for instance suitable when a person lying in the bed needs to have his feet higher than his head. Naturally, the legs can be pivoted the other way around, so that the foot end of the bed will be higher than the head end, which may be suitable if the bed needs to be drained.

Not shown is a configuration of the bed where all sections are horizontally arranged and wherein the long side leg pair 20*b* and 20*d*, has been pivoted downwards in the vertical direction about their hinges with an angle that is smaller than the angle that the other long side leg pair has been pivoted with, which results in that the bed is tilted in its transverse direction. Naturally, even if not shown in any of the figures above, if so needed, one of the long side leg pairs can be pivoted while the other long side leg pair remains still in any of the configurations described above, resulting in that the chair bed will tilt in the transverse direction.

Preferred angles that the movable parts, respectively, have been pivoted with about their corresponding hinges, have not been explicitly mentioned. As for the legs, preferred heights from the floor to surface of the bed are mentioned instead. The angles that the legs need to be pivoted with are thus easily calculated having the length of the legs. However, the angles that the legs are pivoted with are preferably in the range from approximately 5-10° to approximately 100°. When the bed is in the sleep configuration, the legs are preferably not horizontally arranged, i.e. pivoted with an angle of 0°. This is because it would require a large momentum to pivot the legs downwards about their hinges when starting from horizontally arranged legs, especially if there is a person present in the bed. If the legs are pivoted with an angle in the range of 5-10° when the bed is in the sleep configuration, this will not have a substantial effect on the height from the floor to the surface of the bed, but it will reduce the momentum required to pivot the legs further downwards.

As for the sections of the platform, there are in connection with the possible configurations as described above, no particularly preferred angles that the sections, respectively, are pivoted with about their corresponding hinges. The person using the bed is free to pivot a section until he has a comfortable position in the bed. The head section is however, preferably pivoted upwards in the vertical direction about hinge 10 in the range from 0 to approximately 100°. The first foot section 8*a* is preferably pivoted downwards in the vertical direction about hinge 14 in the range from 0 to approximately 100°.

The sections of the platform are preferably provided with means (not shown) that prevents the section to be pivoted about its hinge to a position that may be dangerous for the person in the bed. The same applies for the legs.

Figure 2:
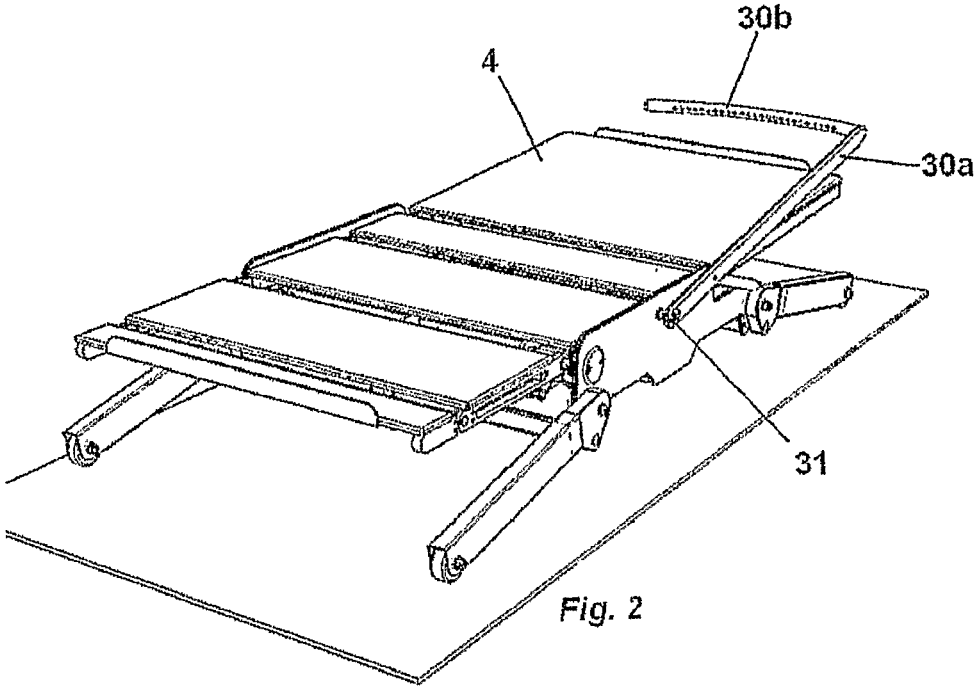
FIG. 2 illustrates the inventive arrangement a seen in an elevated view provided with an assisting means in the form of a handle.

In a further preferred embodiment, the inventive articulated bed arrangement is provided with a handle 30 at one of the long sides of the bed, see FIG. 2. The handle comprises a longitudinal rod 30*a*. One end of the rod 30*a* is connected in an articulated manner about a hinge 31 to one of the outer long sides of the platform, preferably in the centre of the corresponding leg base member. The rod 30*a* is thus adapted to be pivoted about the hinge 31, so that said rod is adapted to be pivoted upwards in the vertical direction from a position wherein the rod essentially extends along the horizontally arranged head end section, towards a position wherein the rod extends along the horizontally arranged foot section of the bed. The handle rod is thus adapted to be pivoted about the hinge 31 with an angle in the range of approximately −90° to 90° in relation to when the rod is perpendicularly arranged.

At the end of the rod 30*a*, opposite to the end connected to the bed, is a handgrip 30*b* provided, such that the handgrip 30*b* extends transverse to the longitudinal direction of the rod 30*a* and transverse to the longitudinal direction of the bed in towards the centre of the bed. The length of the rod 30*a* is adapted so that the handgrip 30*b* is movable over the head end of the bed when the rod is pivoted downwards in the vertical direction about the hinge 31 towards the position wherein the rod extends along the horizontally arranged head end section of the bed. The length of the rod 30*a* is further adapted to be sufficiently short so that the handgrip 30*b* is readily reachable for a person lying in the bed. If the handgrip is not reached by the person when the bed is in the sleeping configuration, the articulated bed can for instance be changed into the sit up configuration described above. The handgrip 30*b* can also be provided with means (not shown) so that the end of the handgrip connected to the rod is adapted to slide down along said rod until the handgrip is reachable.

The handle 30, thus comprising the longitudinal rod 30*a* and the handgrip 30*b*, is provided in order to constitute an assisting means, for instance when a person wants to change his position in bed. If so, said person can pivot the rod 30*a* about the hinge 31, until the handgrip is reachable from the bed.

Figure 3:
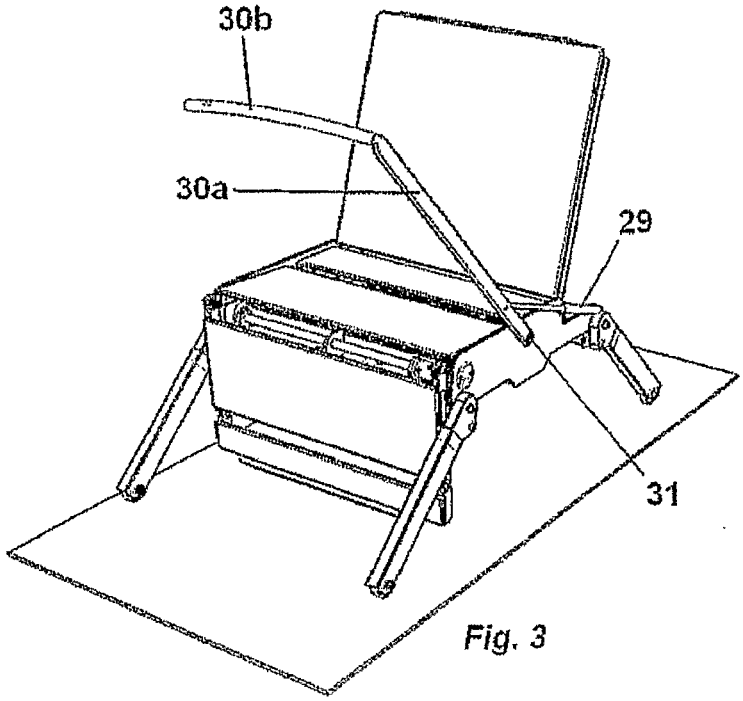
FIG. 3 illustrates the arrangement according to FIG. 2 but when the bed is in the raise from bed configuration

The rod can also be pivoted towards the position wherein the rod extends along the horizontally arranged foot section. The pivoting movement of the rod is preferably stopped at a desired position when the handgrip is positioned just in front of the person. If the bed is in for instance the raise from bed configuration shown in FIG. 1*g*, the handgrip can constitute a means that assists the person when he is standing up in front of the bed/chair, see FIG. 3. The handle may for instance provide a support when the person is getting dressed or undressed.

The means that connects the handle to the bed is in one embodiment provided with gas dampening means 29 controlled by for instance a push-button on the side of the handle. When the person thus wants to pivot the handle, he can activate the push-button, whereupon the handle is easily pivoted until the push-button is released, whereupon the handle is locked in that position. In another embodiment, the handle is moveable by means of actuating means, se further description below.

In an alternative embodiment, the handle comprises a second longitudinal rod 30*a*, provided at the same articulated manner as the first longitudinal rod but at the opposite outer longitudinal side of the bed, at the same distance from the head end of the bed as the first rod. The second rod has the same length as the first rod and is at its end opposite to the end connected to the bed, connected to the end of the handgrip not connected to the first rod. Said alternative embodiment is not shown in any figures.

The movements of the different actively controlled moveable parts of the articulated bed, i.e. the different sections of the platform that are actively controlled, the legs and optionally also the handle rod, can be performed by the means of actuating means. Any commonly known actuator known to be functional in the field can be used in order to put the different movable parts of the articulated bed into mechanical motion. The actuating means are preferably housed in a drive mechanism box (not shown) that besides the actuating means, houses further driving or control means for the inventive articulated bed.

The box is adapted to be placed under the bed, preferably centrally in the longitudinal and transverse direction of the bed and designed in order to occupy as little space as possible under the bed. As mentioned above, the drive mechanism box is adapted to house actuating means in the form of actuators. The box is thus adapted to house all the actuators needed in the particular embodiment of the inventive bed arrangement. An actuator is thus connected to its corresponding moveable part(s) in a way that makes it adapted to put said part(s) into mechanical motion about its corresponding hinge, see explanation below. The drive mechanism box is preferably adapted to further comprise a DC power supply, a preferably programmable control means that controls the movement of the different moveable parts of the bed and which thus is coupled to the actuators, optionally a pump means that is adapted to inflate an inflatable mattress provided on the bed, and a battery pack if the articulated bed is about to be used when there is no access to external power. In short, all drive and control mechanisms of the articulated bed that are necessary for the functions of the bed, is housed in the drive and control mechanism box.

The movement of the different actively controlled moveable parts of the bed is controlled by the person lying in the bed, or another person, for instance by the means of switches provided on the outer long side(s) of the bed, readily reachable for the person lying in bed. Each moveable part can for instance be coupled to such a switch, that when activated sends a signal to the control means which in turn activates the corresponding actuator which puts the part in motion. Such a switch is preferably a two-mode switch so that the part can be moved back and forth, i.e. be pivoted upwards as well as downwards about its hinge.

Preferably, such switches are also provided on a remote control, which is adapted to communicate with the control means.

In a preferred embodiment, the control means is adapted to be programmable. Thus, the different movements of the different actively controlled moveable parts of the arrangement, i.e. the sections 4, 8*a*, the legs 20*a-d*, and optionally the handle rod 30*a* and second foot section 6*b*, that as to be actuated in order to end up with for instance any of the configurations shown an described in connection with FIG. 1*a-h* can be pre-programmed, so that the user of the bed by the means of the push of just one or a few buttons can transform the bed from for instance the sleep configuration to the raise from bed configuration. The arrangement is preferably provided with means so that the articulated bed can bed transformed into any configuration starting out from any such configuration.

The handle can thus for instance be programmed to move from a position wherein it essentially extends along the horizontally arranged head end section towards a position wherein it extends along the horizontally arranged foot section of the bed, during the transformation of the bed from the sleep configuration to the raise configuration. The velocity of the movement of the handle is thus programmed and controlled so that the handgrip at all times during the transformation provides an assisting means for the person lying in bed, i.e. the person can hold on to and be assisted by the handgrip when standing up from the bed. Naturally, the inventive arrangement can be programmed the other way around. That is, a person can be assisted by the handle by holding on to the handgrip, when the articulated bed is transformed into the sleeping configuration from the raise from bed configuration.

Figure 4:
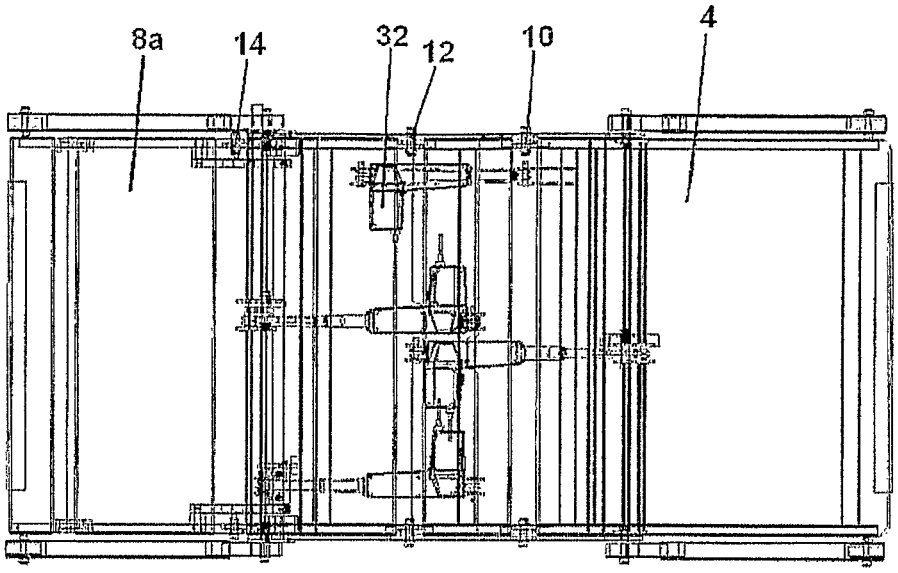
FIG. 4 illustrates the inventive arrangement from above in a translucent view.
Figure 5:
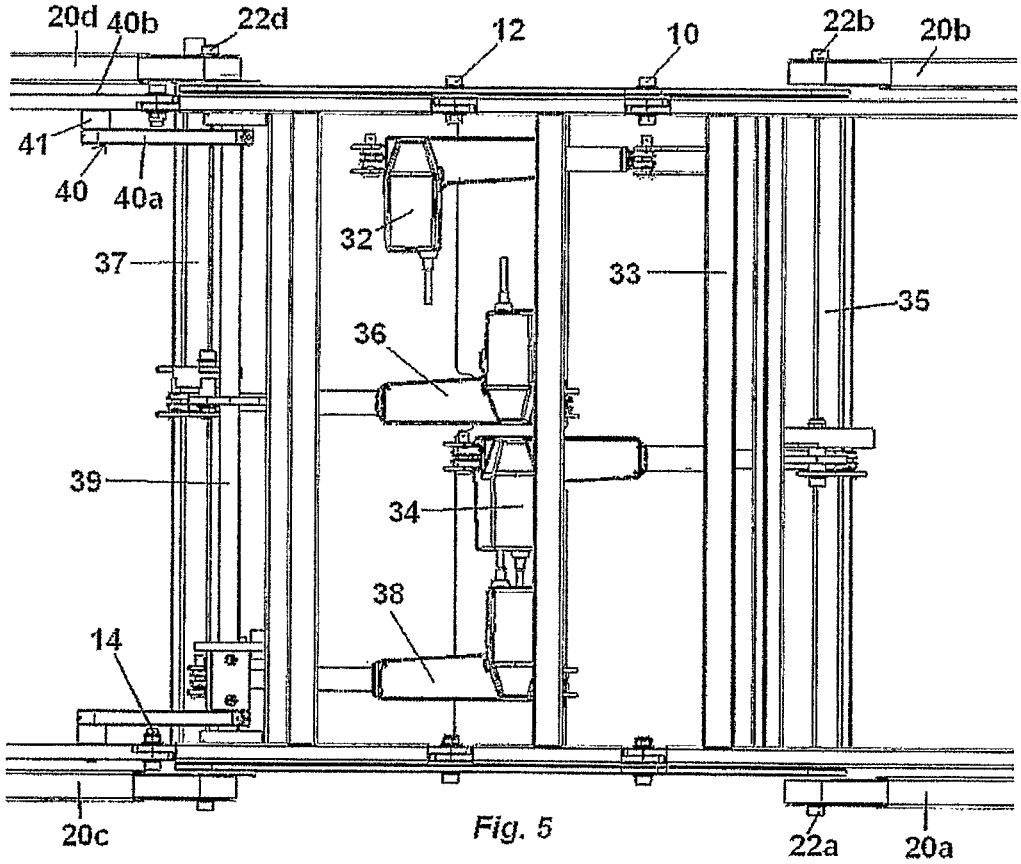
FIG. 5 is a close up of FIG. 4.
Figure 9:
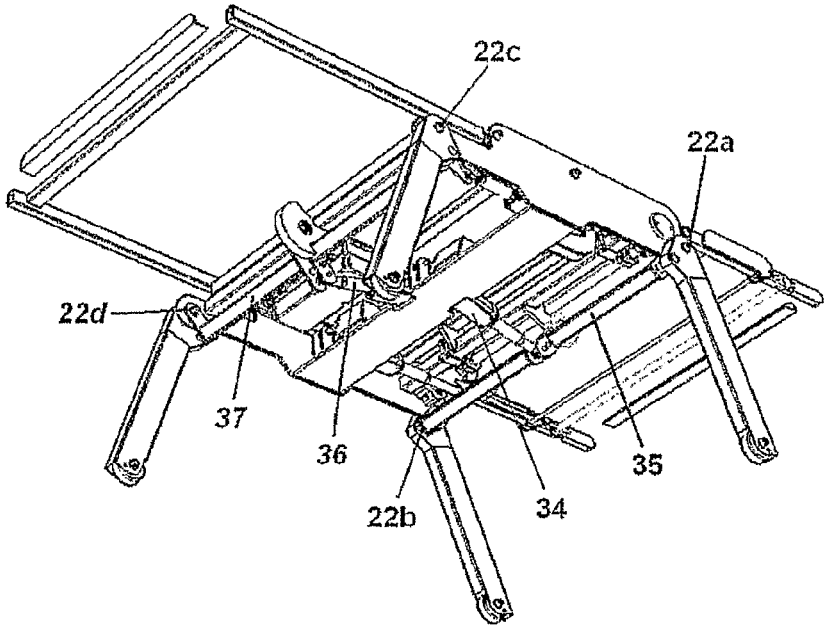
FIG. 9 illustrates the inventive arrangement from underneath.

One way of connecting an actuator to its corresponding actively controlled moveable part(s) in a way that makes it adapted to put said part into mechanical motion about its corresponding hinge can be seen in FIGS. 4, 5 and 9. In these figures, the drive mechanism box has been left out, and what is shown in said figures is how actuators can be connected to their corresponding moveable part(s).

Not shown in any figures is how an actuator can be connected to the second seat section 6*b*. However, having the description provided below at hand, describing how actuators are connected to the head section and first foot section, the skilled person can readily accomplish a connection between an actuator and the second seat section in a way so that said section can be pivoted about its corresponding hinge as described above by means of the actuator. In the preferred embodiment, the second seat section is however made to pivot upwards in the vertical direction about hinge 12, by pivoting the short side leg pair 20*c* and 20*d* downwards in the vertical direction about their corresponding hinges with a large enough angle as compared to the angle that the short side leg pair 20*a* and 20*b* is pivoted downwards with, see FIG. 1*e*. Said section is thus not actively controlled but is made to move when the short side leg pairs are actively pivoted.

If the handle rod is to be pivoted by means of an actuator, the skilled person is also in this case capable of connecting an actuator to said rod in a suitable way having the description below at hand. Neither is shown in any figures, how the actuators that put the legs into mechanical motion, are connected when the legs are adapted to be moved in terms of long side leg pairs. This can however be accomplished by for instance having a separate actuator for each leg.

No actuator is needed for pivoting the second foot section 8*b* upwards in the vertical direction about hinge 16. Said section can be pivoted by hand and is for instance pivoted upwards when the section hits the floor when the first foot section is pivoted downwards as described above. The second foot section is thus not an actively controlled movable part. First seat section 6*a* is preferably horizontally fixed.

Now turning to FIGS. 4, 5 and 9; actuator 32 is connected to a transverse rod 33 of the head section 4, such that when actuator 32 is activated and acts on the rod 33, the transverse rod is urged upwards or downwards in the vertical direction depending on if the actuator is driven forwards or backwards, which results in that the head section is pivoted upwards, or downwards, in the vertical direction about hinge 10. The actuator 32 also provides for a lock means of the head section. That is, when the head section has reached the desired position and the actuator is deactivated, the motor of the actuator still prevents that the head section is pivoted further, i.e. the motor locks the head section in the desired position.

In a preferred embodiment, actuator 34 and 36, respectively, is connected to transverse rods 35 and 37, respectively, positioned close to the under surface of the platform 2 transverse the longitudinal direction of the bed, in order to occupy as little place as possible under the bed. Transverse rod 35 is in one end firmly connected to leg 20*a* and in the other end firmly connected to leg 20 *b*. However, the transverse rod 35 is also connected to the hinges 22*a* and 22*b*. Thus, when the actuator 34 is activated and driven forward, the rod 35 is urged forwards and pivots about the hinges 22*a* and 22*b*, which urges the short side leg pair 20*a* and 20*b* to be pivoted upwards in the vertical direction about the hinges 22*a* and 22*b*, see FIG. 9. Naturally, if the actuator 34 is driven backwards, the legs 20*a* and 20*b* are in the same way urged to be pivoted downwards in the vertical direction about their corresponding hinges. Actuator 36, transverse rod 37, short side leg pair 20*c* and 20*d* and the hinges 22*c* and 22*d* are connected to each other in the same way and follow the same movement pattern as described above in connection with short side leg pair 20*a* and 20*b*. The lock means described above in connection with actuator 32, also applies for the actuators 34 and 36. That is, when a short side leg pair has been pivoted with a desired angle and the corresponding actuator is deactivated, the motor of said actuator still prevents that the leg pair is pivoted further, i.e. the motor locks the leg pair in the desired position.

Figure 10:
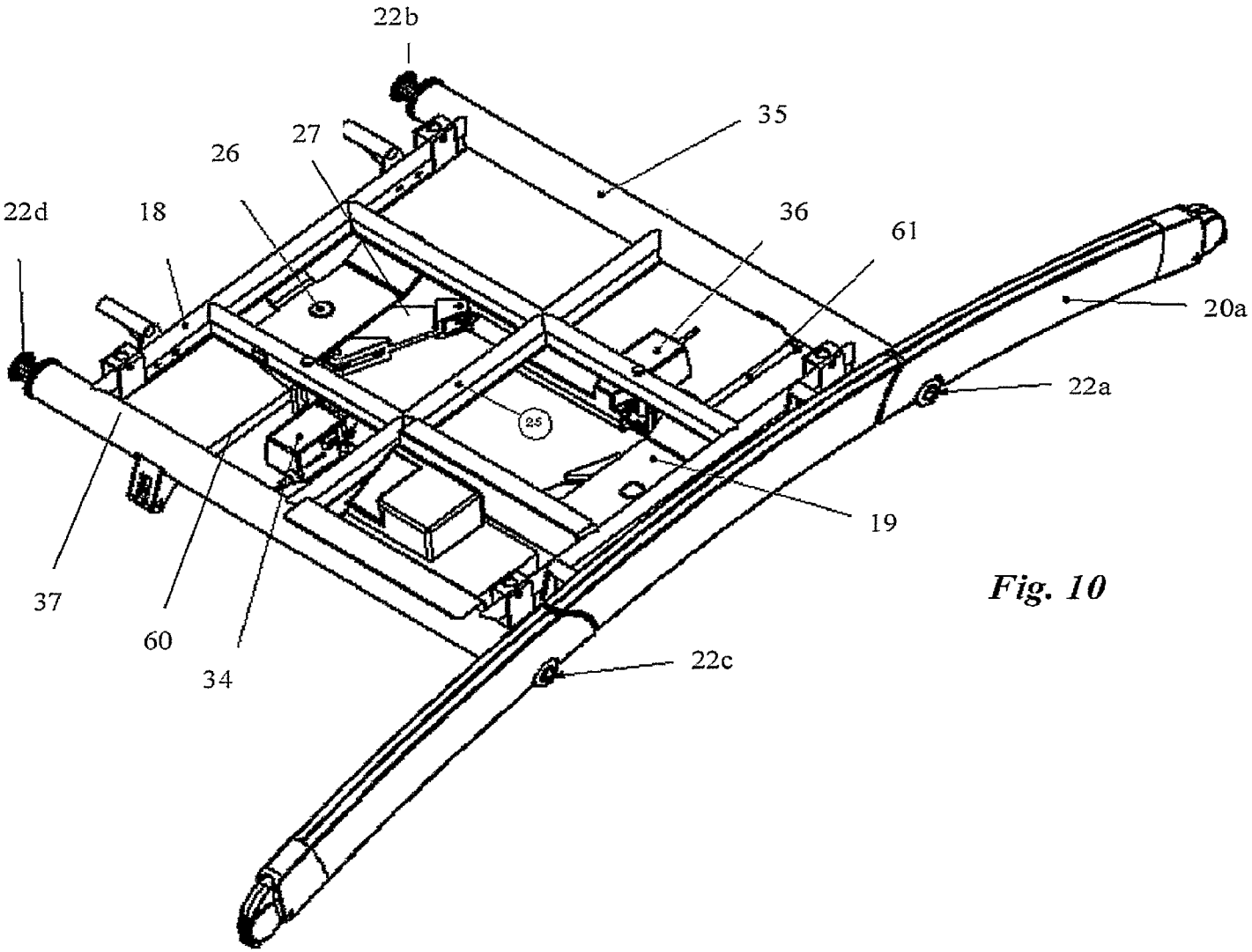
FIG. 10 illustrates a gear mechanism of the inventive arrangement as seen from above.

In a second embodiment, as shown in FIG. 10, a base frame 25 extends transversally and longitudinally under the platform. The ends of the base frame 25 are attached by suitable attaching means to the leg base members 18 and to the transverse rods 35, 37 respectively. A gear mechanism comprising at least one pivot bolt 26; at least one triangular plate 27 and at least a rod 60, 61; is attached to the base frame 25 through at least a flange 19. At each flange 19, one end of each triangular plate 27 is connected through a pivot bolt 26. At the second end of each triangular plate 27, one end of each rod 60, 61; is pivotally connected. Further, at the other end of each rod 60, 61; is connected to each of the transverse rods 35 and 37, respectively, by suitable attaching means. At the third end of each triangular plate 27, one end of each actuator 34 and 36, respectively, is pivotally connected. At the other end of each actuator 34 and 36 is pivotally connected to the base frame 25 by suitable attaching means. Thus, when the actuator 34 is activated and driven forward, the rod 35 is urged backwards and pivots about the hinges 22*a* and 22*b*, which urges the short side leg pair 20*a* and 20*b* to be pivoted downwards in the vertical direction about the hinges 22*a* and 22*b*. Obviously, if the actuator 34 is driven backwards, the legs 20*a* and 20*b* are in the same way urged to be pivoted upwards in the vertical direction about their corresponding hinges. Actuator 36, transverse rod 37, short side leg pair 20*c* and 20*d* and the hinges 22*c* and 22*d* are connected to each other in the same way and follow the same movement pattern as described above in connection with short side leg pair 20*a* and 20*b*. This gear mechanism (26, 27, 60; 26, 27, 61) offers to make the best use of the efficiency from the actuators to pivot each leg pair in an articulated manner wherein each pair is adapted to be independently operated.

Figure 6:
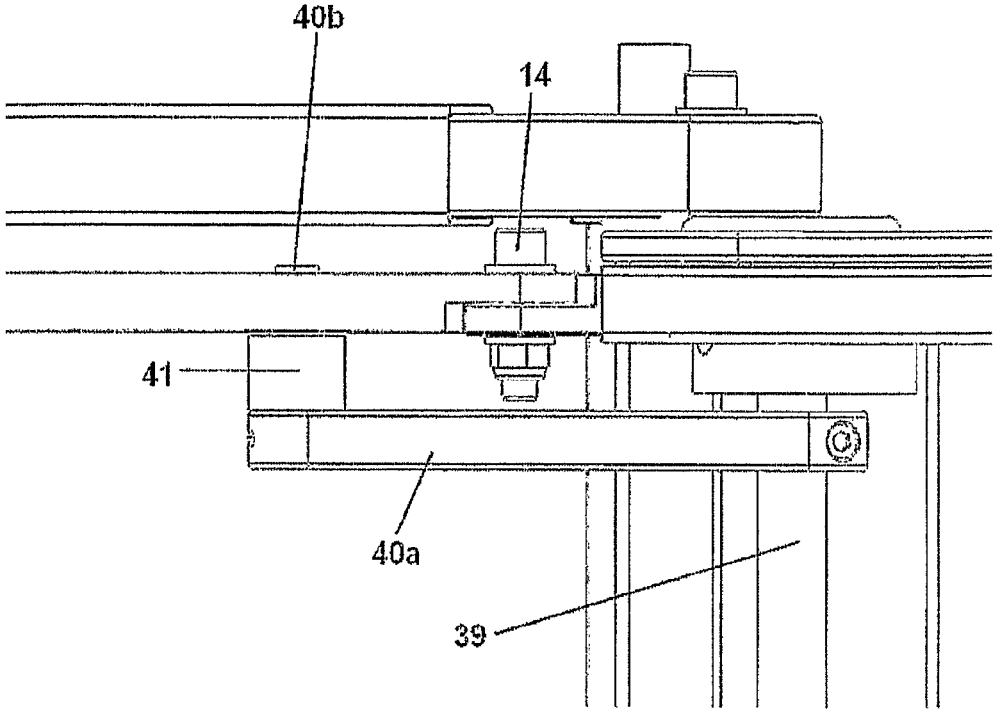
FIG. 6 is a close up of a lifter means provided at the first foot section.

Actuator 38 is connected to a transverse rod 39 extending transverse the bed under the platform. One end of the rod 39 is rotatably connected to the inner side of one of the leg base members 18, and the other side of the rod 39 is thus rotatably connected to the inner side of the other leg base member. The connection points between the rod 39 and the leg base members are located close to the longitudinal ends of the leg base members being closest to the foot end of the bed. At each end of the rod 39 is a lifter means 40 firmly provided. Each of the lifter means 40 comprises an arm 40*a* provided with a pin 40*b*, surrounded by a spacer means 41, see FIG. 6. The arms 40*a* extend from the rod 39 and in the direction towards the foot end of the bed. Each of the pins 40*b* are adapted to be slidably arranged in through going slits 42 provided in the longitudinal sides of the first foot section 8*a*. That is, there is one such slit 42 provided at each longitudinal side of the first foot section. When the first foot section is horizontally arranged, the lift arms 40*a* are extending obliquely upwards if the pins 40*b* are to be provided in the slits 42. When the first foot section is to be pivoted downwards about the hinge 14, the actuator 38 is thus driven backwards which will rotate the rod 39 forwards. This results in that the arms 40*a* are pivoted downwards in the vertical direction about their connection points to the rod 39, such that the pins 40*b* are urging the first foot section 8*a* to pivot about the hinge 14 while said pins 40*b* are sliding forward in the slits 42. Naturally, the above described movement can be carried out the other way around, pivoting the first section upwards to its original horizontally arranged position.

The lock means described above in connection with actuator 32, 34 and 36 also applies for actuator 38. That is, when the first foot section has been pivoted with a desired angle and the actuator 38 is deactivated, the motor of said actuator still prevents that the section is pivoted further, i.e. the motor locks the section in the desired position.

Figure 7:
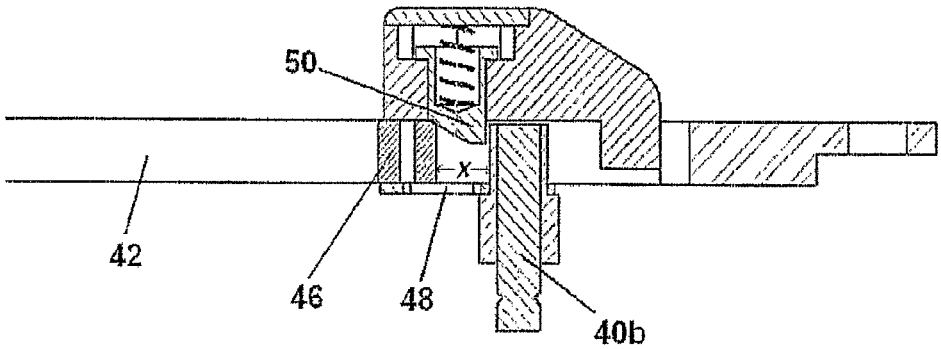
FIG. 7 illustrates one locking means for the first foot section as seen from above, partly in cross section.

However, the first foot section 8*a* is subjected to relatively high forces, especially if a person is sitting on the foot end of the bed. This can result in that the pin 40*b* is made to slide along the slit 42, which is undesirable if the foot section should be held horizontally arranged. Therefore, the first foot section is preferably provided with further locking means that locks said section in the desired position. One such locking means configuration is shown in FIG. 7, wherein the right hand side of the figure is closer to the head end of the bed. In FIG. 7, the first foot section 8*a* is seen held locked when substantially horizontally arranged. The pin 40*b* is thus provided in the slit 42, close to the longitudinal end of said slit which is closest to the head end of the bed. The locking means comprises a second pin 46 provided slideably in the slit 42, ahead of pin 40*b* with a certain distance x, if said slit is said to extend from the head end of the bed towards the foot end of the bed. The pin 40*b* is slideably connected to a backing support 48, also connected to the second pin 46. In FIG. 7, is seen how the pin 40*b* is prevented from moving forward in the slit 42 by means of a spring suspended catch 50. The first foot section is thus locked in the horizontally arranged position.

If the first foot section is to be pivoted downwards, said section first needs to be pivoted upwards so that the second pin 46 and the pin 40*b* is moved towards the head end of the bed. When the pin 40*b* reaches the end of the slit being located closest to the head end of the bed, the distance to the second pin 46 is still x, whereby said pin 46 has urged the spring suspended catch 50 to move out of the way from the slit 42. Now the first foot section can be pivoted downwards resulting in that the pin 40*b* will move forward in the slit 42 while the second pin 46 remains still, i.e. the distance x will be equal to 0 (zero) when the pin 40*b* meets the second pin 46. Since the second pin 46 has urged the catch 50 out of the way from the slit 42, both pins can continue the forward movement in the slit 42 pivoting the first foot section downwards. Due to the bevelled edge of the catch 50, i.e. the edge of the catch protruding into the slit 42, pin 40*b* can move towards the head end of the bed urging the catch to move out of the way from the slit when the first foot section is pivoted upwards towards a horizontally arranged position.

Figure 8:
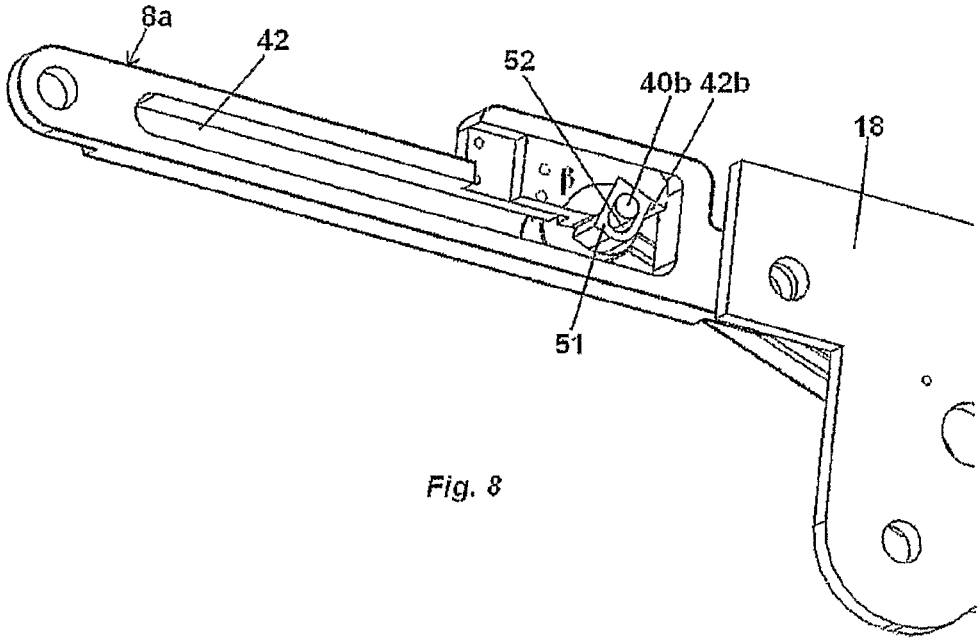
FIG. 8 illustrates another locking means for the first foot section as seen in an elevation view from the outside of the bed.

Another such locking means configuration which locks the first foot section in the horizontally arranged position is shown in FIG. 8. In this configuration, the slits 42 provided in the longitudinal sides of the first foot section, are construed as to have an obliquely upward towards the head end of the bed extending bend 42*b*. There is thus a predetermined angle β of the corner between the longitudinal slit 42 and its corresponding bend 42*b*. In said slit 42 and in its corresponding bend 42*b* a locking member 51 is slideably arranged. The locking member is provided with a through going longitudinal opening 52 having a predetermined length. The opening 52 is adapted to house the pin 40*b*, so that said pin 40*b* is adapted to slide from one longitudinal end to the other longitudinal end of the opening 52. In FIG. 8 is shown when the pin 40*b* is provided in the upper longitudinal end of the opening 52.

So, when the foot section 8*a* is horizontally arranged in the locked position, the lift arms 40*a* are extending obliquely upwards, with the pins 40*b* provided in the upper ends of the openings 52, and with the locking member 51 provided in the bend 42*b* with its longitudinal sides in line with the side wall of the bend being closest to the foot end of the bed, as seen in FIG. 8. When the locking member is provided in the bend 42*b* in the way as above described, the first foot section is prevented from moving downwards even if there is a substantial force acting on the foot section. That is, due to a suitable value of the angle β the first foot section is effectively locked in its horizontal position.

When the first foot section is to be pivoted downwards about the hinge 14, the actuator 38 is thus driven backwards, rotating the rod 39 forward, which results in that the arms 40*a* are pivoted downwards in the vertical direction about their connection points to the rod 39. This will initially result in that the pins 40*b* will travel in the openings 52 to the under ends of said openings. The length of the opening 52 should therefore be so designed, that the distance from the under end of the locking member 51 to the centre of the pin 40*b* (as seen in a cross-sectional view of the short side thereof) when said pin is provided in the under end of the opening 52, is sufficiently short in order for the locking member 51 to be urged round the corner between the slit 42 and the bend 42*b* by means of the pin 40*b* when the arm 40*a* continues its downwards pivoting movement. As soon as the locking member has passed round said corner, the pin 40*b* and the locking member 51 can continue their movements forward in the slit 42, urging the first foot section 8*a* to pivot downwards in the vertical direction about the hinge 14.

When the first foot section is to be pivoted upwards in the vertical direction about hinge 14, the arms 40*a* are pivoted upwards urging the pin 40*b* and consequently also the locking member 51 to move backwards in the slit 42, urging the first foot section to be pivoted upwards in the vertical direction about hinge 14 until the locking member pass round the corner between the slit 42 and the bend 42*b*. When the locking member has passed round said corner and when its longitudinal sides are in line with the side wall of the bend being closest to the foot end of the bed, the first foot section is horizontally arranged. Said foot section will be locked in the horizontal position, when pin 40*b* is provided in the upper end of the opening 52 as described above. The angle β should therefore also be chosen in order for the locking member to easily pass round the above mentioned corner in both directions not resulting in any additional load on the arms 40*a*. A currently preferred value for the angle β is 110°.

Also the head section 4 of the bed can be provided with similar locking means as described above in connection with the first foot section.

The inventive bed arrangement is adapted to be provided with different accessories. As mentioned above, the platform is adapted to be provided with a mattress. In the art mattresses that have different inflatable sections are known. Such a mattress provided with sections that for instance correspond to the different sections of the bed, can be used with the inventive arrangement. Alternatively a pressure ulcer mattress can be used. Further, a light source can be provided in the handgrip, so that when the handgrip not is used as an assisting means, the handgrip can be used as a reading lamp. Also different types of handles or armrests are adapted to be provided onto the sides of the bed. Such handles or armrests can for instance be adapted to function as a security support that reduces the possibility for a person to fall out of bed when sleeping. Also the articulated bed of the present invention is preferably provided with means so that said bed is adapted to have a double bed function.

The drive means that put the different actively controlled moveable parts in to motion, has been described above as to preferably be accomplished by means of actuating means. However, this can also be accomplished by means of for instance electric motors. As for example, the legs can be made to pivot about their corresponding hinges if provided with electric motors in their wheels.

Even though the inventive bed articulated bed has been described to be used in the home environment of a disabled person, it is to be understood the bed according to the present invention is to be used in any environment of choice, such as a hospital or within a special care living arrangement.

The invention claimed is:

1. An articulated bed arrangement, comprising:

a patient support platform including at least a head section, a seat section, and a foot section connected to each other in an articulated manner so that the bed arrangement is convertible at least from a bed configuration to a chair configuration, the platform having a length and a width whereupon the platform projects an area onto a floor when the sections are horizontally arranged, a leg arrangement that is movable to change a height from the floor to a surface of the platform and that includes four legs and two leg base members, wherein each leg base member is connected to a respective outer long side of the platform, each leg is connected to a leg base member at a longitudinal end of the leg base member in an articulated manner such that each leg is pivotable in a vertical direction relative to a longitudinal direction of the platform about its articulated connection point, two legs are provided at opposite long sides of the bed arrangement closer to and at substantially the same distance from a head end of the bed arrangement, two other legs are provided at opposite long sides of the bed arrangement closer to and at substantially the same distance from a foot end of the bed arrangement, and each leg is positioned outside the projected area;

wherein lengths of the leg base members are approximately a length of the seat section.

2. The articulated bed arrangement of claim 1, wherein two of the legs in a first leg pair are connected to opposite long sides of the platform with the same distance from a head end of the bed and closer to the head end than to a foot end of the bed, the other two legs in a second leg pair are connected to opposite long sides of the platform with the same distance from the foot end of the bed and closer to the foot end than to the head end of the bed, the legs of the first and the second leg pairs are adapted to be pivoted as pairs, and each leg pair is adapted to be independently operated.

3. The articulated bed arrangement of claim 2, wherein the first leg pair is adapted to be independently pivoted about its connection points so that a height from the floor to the head end of the bed can be adjusted in relation to the foot end, and the second leg pair is adapted to be independently pivoted about its connection points so that the height from the floor to the foot end of the bed can be adjusted in relation to the head end.

4. The articulated bed arrangement of claim 2, wherein the first and second leg pairs are adapted to be pivoted as pairs about their connection points so that a height from the floor to the surface of the platform can be adjusted.

5. The articulated bed arrangement of claim 1, wherein the head and seat sections are connected in an articulated manner about an articulated connection point such that the head section is pivotable upwards in the vertical direction, and the foot and seat sections are connected in an articulated manner about an articulated connection point such that the foot section is pivotable downwards in the vertical direction.

6. The articulated bed arrangement of claim 1, wherein the seat section comprises first and second seat sections connected to each other in an articulated manner, the second seat section is positioned closer to the foot end of the bed than the first seat section, and the second seat section is adapted to be pivoted upwards in the vertical direction about its articulated connection point to the first seat section.

7. The articulated bed arrangement of claim 1, wherein the foot section comprises first and second foot sections connected to each other in an articulated manner, the second foot section is positioned closer to the foot end of the bed than the first foot section, and the second foot section is adapted to be pivoted upwards in the vertical direction about its articulated connection point to the first foot section.

8. The articulated bed arrangement of claim 6, wherein the arrangement is adapted to assume a configuration in which the head end section is pivoted upwards in the vertical direction about its articulated connection point to the seat section, the foot section is pivoted downwards in the vertical direction about its articulated connection point to the seat section, and the second leg pair is pivoted downwards in the vertical direction at an angle that is larger than an angle that the first leg pair is pivoted downwards in the vertical direction, so that the second seat section is pivoted upwards in the vertical direction about its articulated connection point to the first seat section, whereby the configuration facilitates sitting with bowed legs in the bed arrangement.

9. The articulated bed arrangement of claim 2, wherein the arrangement is adapted to assume a configuration in which the head section is pivoted upwards in the vertical direction about its articulated connection point to the seat section, the foot section is pivoted downwards in the vertical direction about its articulated connection point to the seat section, so that the foot section is folded under the platform, and the first leg pair is pivoted downwards in the vertical direction at an angle that is larger than an angle that the second leg pair is pivoted downwards in the vertical direction, whereby the configuration facilitates patient egress from the foot end of the bed.

10. The articulated bed arrangement of claim 1, further comprising an assisting device that includes a longitudinal handle rod connected at one end in an articulated manner to at least one of the outer long sides of the platform, wherein the rod is adapted to be pivoted upwards in the vertical direction from a first position in which the rod extends along a horizontally arranged head section toward a second position in which the rod extends along a horizontally arranged foot section, the other end of the rod is provided with a handgrip that extends transverse to a longitudinal direction of the rod and transverse to the longitudinal direction of the platform toward a center of the platform.

11. The articulated bed arrangement of claim 1, further comprising a gear mechanism arranged to pivot pairs of the legs in an articulated manner, wherein each pair is independently pivotable.

* * * * *